United States Patent [19]

Reiner

[11] 4,364,667

[45] Dec. 21, 1982

[54] MIXING AND TRANSPORT CONVEYOR

[76] Inventor: Ralph E. Reiner, 6474 Chestnut La., Orchard Park, N.Y. 14127

[21] Appl. No.: 231,965

[22] Filed: Feb. 6, 1981

[51] Int. Cl.[3] ..... B01F 7/04

[52] U.S. Cl. ..... 366/325; 198/664

[58] Field of Search ..... 366/133, 154, 155, 183, 366/186, 194, 196, 195, 325, 326, 328, 330, 342, 343, 279, 327; 198/664; 416/237

[56] References Cited

U.S. PATENT DOCUMENTS 2,650,807 9/1953 Bilek ..... 366/196

3,980,282 9/1976 Burch et al. ..... 366/330 X

FOREIGN PATENT DOCUMENTS 147597 1/1950 Australia .

912843 8/1946 France .

*Primary Examiner*—Philip R. Coe

*Assistant Examiner*—Joseph M. Pitko

*Attorney, Agent, or Firm*—Bean, Kauffman & Bean

[57] ABSTRACT

A conveyor construction is disclosed as having particular utility in effecting simultaneous mixing and transporting a relatively viscous charge of finely divided fruit and pressing aid for supply to a fruit juice extraction press. The construction features a novel mixing and transport paddle formed by bending a relatively thin metal plate to define separate mixing and transport surfaces.

14 Claims, 6 Drawing Figures

MIXING AND TRANSPORT CONVEYOR

BACKGROUND OF THE INVENTION

In my prior U.S. patent applications Ser. No. 195,500 filed Oct. 9, 1980, which is a continuation of now abandoned application Ser. No. 36,062 filed May 4, 1979, and Ser. No. 81,139, filed Oct. 2, 1979, which is a continuation in part of such abandoned application Ser. No. 36,062, now U.S. Pat. Nos. 4,303,011 and 4,267,770, respectively there is disclosed an improved press for use in squeezing a charge of fruit to extract juice therefrom.

It is conventional practice, when fruit, such as apples, are to be pressed, to add a pressing aid, such as rice hulls or wood fiber, to a charge of finely divided apples prior to introduction of such charge into a press in order to enhance the quantity and quality of juice extracted during the pressing or squeezing operation and to facilitate separation or discharge from the press of pulp after extraction of juice therefrom. It is desirable to limit the quantity of rice hulls employed, while at the same time to achieve distribution of hulls throughout the charge. While obviously, this desired result can be obtained by insuring a uniform distribution of hulls, consistent uniformity appears difficult to obtain in practice with commercially mixing units available at reasonable cost.

SUMMARY OF THE INVENTION

The present invention is directed to an improved conveyor construction particularly adapted for use in supplying charges of fruit to hoppers associated with a press of the type disclosed in my above mentioned patent applications, characterized in that such conveyor is of both relatively low cost construction and capable of quickly achieving essentially uniform distribution of pressing aid within the charge incident to transport of the charge for supply to the hoppers.

The present conveyor includes a mixing trough having inlet and outlet ends between which extends a material mixing/transport device consisting of a drive shaft to which are fixed a plurality of paddles of novel design and construction. The trough is preferably supported adjacent its inlet end for pivotal movements about a vertically disposed axis in order to selectively position its outlet end in overlying vertical alignment with hoppers to be filled. Preferably, the outlet end of the trough includes downwardly opening discharge or outlet opening sized to extend essentially co-extensive widthwise of the trough and for a distance lengthwise thereof sufficient to insure essentially unobstructed discharge of the charge.

In accordance with a preferred form of the present invention, the paddles are inexpensively fabricated by bending a generally rectangular, relatively thin metal plate to define a mounting flange portion adapted to be suitably fixed to the driven shaft; a transport or conveying flange portion of a form approximating an isosceles trapezoid with its side edges converging in a direction extending away from the mounting flange portion to which it is joined in an upstanding relationship; and a pair of mixing flange portions arranged to extend in opposite directions from adjacent the converging side edges of the transport flange portion. Suitable means may be employed to fix the paddle for rotation with the driven shaft, such as may be defined by a threaded fastener fixed to depend from the mounting flange portion.

The opposite side edges of the transport flange portion may be considered to be leading or downstream and trailing or upstream side edges with reference to the outlet and inlet ends of the conveyor, respectively, whereas the surfaces of such flange portions extending between such edges may be considered to be leading or transport and trailing or following surfaces with reference to the direction of rotation of the drive shaft. In a like fashion, the mixing flange portions joined to the leading and trailing edges of the transport flange portion may be considered to be leading and trailing mixing flange portions and to project in downstream and upstream directions relative to the path of travel of material between the inlet and outlet ends of the conveyor.

When a paddle of the present invention is fixed to the drive shaft the leading surface of its transport flange portion assumes an obtuse angle or pitch relative to the rotational axis of the drive shaft, whose value determines the transport or conveying effect of the paddle on the material and is in turn determined by the properties of such material. Preferably, the angles through which the leading and trailing mixing flange portions are bent relative to the transport flange portion are such that the mixing flange portions are disposed essentially parallel to the axis of shaft rotation for all angular orientations of the transport flange portion in order to maximize the mixing effect thereof of the material being conveyed.

DRAWINGS

The nature and mode of operation of the present invention will now be more fully described in the following detailed description taken with the accompanying drawings wherein.

DETAILED DESCRIPTION

Figures 1, 2, 3, 4, 5, 6, 7:
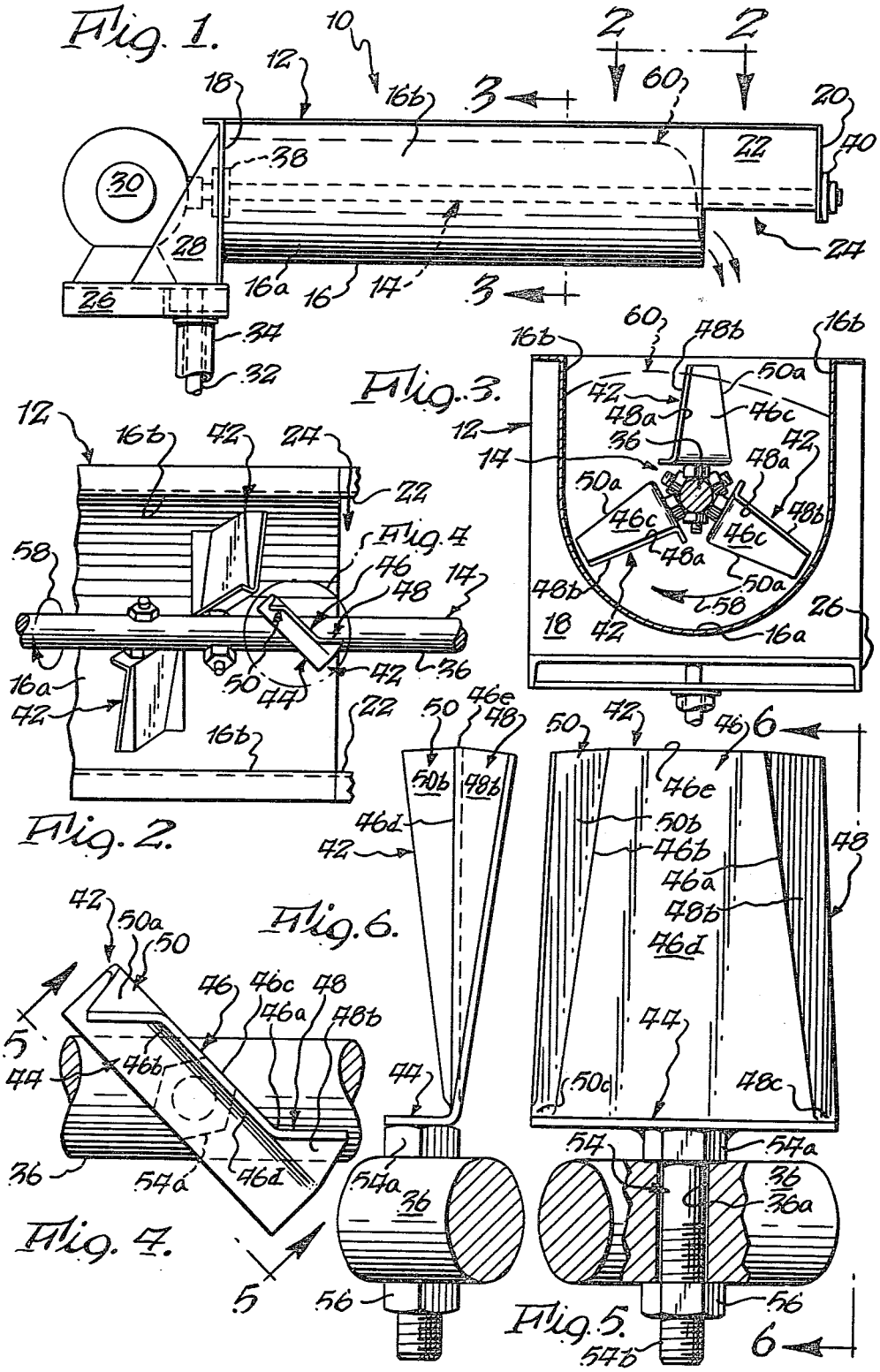
FIG. 1 is a side elevational view of a material conveyor constructed in accordance with the present invention.
FIG. 2 is a partial top plan view of the conveyor, as viewed in the area designated as 2—2 in FIG. 1.
FIG. 3 is a sectional view taken generally along the line 3—3 in FIG. 1.
FIG. 4 is an enlarged view of the area designated as FIG. 4 in FIG. 2.
FIG. 5 is an elevational view showing trailing surfaces of a paddle, as viewed along line 5—5 in FIG. 4.
FIG. 6 is an elevational view showing leading edge surfaces of a paddle, as viewed along line 6—6 in FIG. 5.

Reference is first made to FIGS. 1-3, wherein a conveyor constructed in accordance with the present invention is generally designated as 10 and shown as including a mixing trough 12 housing a material mixing and transport device or conveyor 14. Trough 12 comprises an elongated, U-shaped sheet metal mixing section 16 having a curved lower section **16*a* and straight, parallel side sections 16*b* and 16*b*; a first transversely extending plate 18, which is fixed to first end edges of sections 16*a*, 16*b* and 16*b* and cooperates therewith to define a first or inlet end of the trough; and a second transversely extending plate 20, which is fixed in a spaced, parallel relationship to second or opposite end edges of sections 16*a*, 16*b* and 16*b* by a pair of straight, parallel side plates 22 and 22 and cooperates therewith to define a second or outlet end of the trough. It will be understood by referring to FIGS. 1 and 2, that side plates 22 and 22 cooperate with the second end edges of mixing section 16 and second end plate 20 to define a material discharge or outlet opening 24, which is coextensive with the widthwise dimension of section 16** and extends in a direction lengthwise thereof sufficient to insure essentially unobstructed discharge of material from the trough.

Conveyor 10 is preferably supported adjacent the inlet end of trough 12 for pivotal movements about a vertically disposed axis in order to selectively position discharge opening 24 in overlying vertical alignment with the charge receiving hoppers of a fruit or like press, not shown, which may for instance be constructed in accordance with the disclosures of my above mentioned patent applications. To this end, first plate 18 may be fixed to a bracket or platform 26 with the aid of suitable bracing plates 28; the platform serving to mount a suitable motor/gear box depicted generally as 30 and in turn being mounted for pivotal movement by a bearing post 32 rotatably received within a tubular column 34. Suitable control means, not shown, may be employed to control operation of motor/gear box 30 and to impart pivotal or oscillating movements to platform 26 to control positioning of discharge opening 24. Such control means may be conventional in all respects, and thus is not illustrated in order to expedite description of the present invention.

Again referring to FIGS. 1–3, it will be understood that material mixing and transport device or conveyor 14 comprises a drive shaft 36, which extends lengthwise of trough 12 and is rotatably supported adjacent its opposite ends by bearing devices 38 and 40 carried by end plates 18 and 20, respectively; and a pluraity of mixing and transport paddles 42, which are preferably uniformly spaced apart lengthwise of section 16 and angularly offset about the axis in a uniform manner, as depicted in FIGS. 2 and 3. Shaft 36 may be suitably coupled for rotation under the control of motor/gear box 30.

Paddles 42, which preferably are of like construction, will now be described with particular reference to the downstream of endmost paddle depicted in FIG. 2 and shown on an enlarged scale in FIGS. 4–6. Specifically, paddle 42 is shown as including a generally rectangular mounting flange portion 44; a transport or conveying flange portion 46, which is arranged to upstand from mounting flange portion to which it is joined; and a pair of mixing flange portions 48 and 50, which are joined to and extend in opposite directions from adjacent opposite side edges **46*a* and 46*b* of flange portion 46. Paddle 42 is preferably adjustably fixed to shaft 36 by means of a threaded fastener in the form of a bolt 54, which has its head portion 54*a* welded to mounting flange portion 44 and its threaded shank end portion 54*b* retained by nut 56 within a radially extending, through bore opening 36*a* provided in the shaft. Alternatively, if desired, mounting flange portion 44 may be otherwise fixed to shaft 36**, such as by welding.

With paddle 42 mounted on shaft 36 in the manner depicted in the drawings, opposite side edges **46*a* and 46*b* may be considered to be leading or downstream and trailing or upstream edges with reference to the above mentioned outlet and inlet ends of conveyor 12, respectively; and the surfaces 46*c* and 46*d*, which extend between such opposite side edges may be considered to be leading or transport and trailing or following surfaces of the transport flange portion with reference to the direction of rotation of drive shaft 36 represented by arrow 58 in FIGS. 2 and 3. Similarly, flange portions 48 and 50 may be considered to be leading and trailing mixing flange portions and to project in downstream and upstream directions relative to the path of travel of material between the inlet and outlet ends of conveyor 12, and their surfaces 48*a* and 50*a* and 48*b* and 50*b*, which form continuations of surfaces 46*c* and 46*d***, may be considered leading or mixing and trailing or following surfaces, respectively.

In accordance with the presently preferred construction, paddle 42 is fabricated by bending a generally rectangular, relatively thin metal plate to define flange portions 44, 46, 48 and 50; the nature of the bending serving to impart substantial rigidity to the paddle even when thin stock material is employed, as well as providing a novel paddle configuration having superior mixing and transport capabilities. More specifically, in the preferred construction, the metal plate is bent such that side edges **46*a* and 46*b* converge in a direction away from mounting flange portion 44, such that transport flange surfaces 46*c* and 46*d* approximate isosceles trapezoids and mixing flange portions 48 and 50 lie essentialy within planes, which interesect along a line disposed outwardly of the free or radially outer edge 46*e* of the transport flange portion. Preferably, the radially inner ends of side edges 46*a* and 46*b* are slightly inset or spaced inwardly from the ends of mounting flange portion 44, as best shown in FIG. 5, such that the inner ends 48*c* and 50*c* of mixing flange portions 48 and 50 are joined to the mounting flange portion resulting in substantially enhanced rigidity of the paddle. In the resultant construction, the area of surface 46*c* available for conveying and the areas of surfaces 48*a* and 50*a* available for mixing progressively decrease and increase, respectively in a direction radially outwardly of the axis of shaft 36**.

Further, in accordance with the present invention, leading surface **46*c* of transport flange portion 46 is arranged to assume an obtuse angle or pitch relative to the axis of shaft 36, whose value determines the transport or conveying effect of the paddle on the material within section 16 and is in turn determined by the properties of such material and the desired residence time of the material for mixing purposes. For all such angles, however, it is preferable to bend mixing flange portions 48 and 50 through angles resulting in their leading surfaces 48*a* and 50*a* being disposed essentially parallel to the axis of the shaft, as best shown in FIGS. 3 and 4, in order to maximize the mixing effect imparted to the material within section 16**.

Having described the present invention in general terms, a specific illustration of a commercially available conveyor construction will now be discussed with reference to its use in providing a uniform mixture of finely divided apples and rice hulls employed as a pressing aid. More specifically, paddles 42 are formed of approximately 3/32 inch thick, rectangular stainless steel plate stock having dimensions of approximately $3\times4$ inches resulting in transport flange portion 46 having a radial or lengthwise dimension on the order of about $3\frac{1}{2}$ inches and a widthwise dimension varying from about $2\frac{1}{2}$ inches adjacent mounting flange portion 44 to about $1\frac{1}{2}$ inches adjacent edge **46*e*. In that a preferred pitch angle of transport surface 46*c* of the transport flange portion relative to the axis of shaft 36 has been found to be approximately 127°, mixing surfaces 48*a* and 50*a* are disposed at angles of approximately 127° and 233° relative to transport surface 46*c*, respectively, as measured adjacent the free outer end of the paddle. Sixteen paddles are fixed to a $1\frac{3}{8}$ inch diameter stainless steel shaft in a uniform 3 inch center-to-center spacing lengthwise thereof within the bounds of section 16 and arranged in a spiralwise relationship with approximately 120° angular spacing between adjacent paddles. Section 16 is roll formed from stainless steel sheet stock and has length, width and height dimensions of about 4 feet, $10\frac{1}{2}$ and 11 inches, respectively. A suitable cover formed of transparent plastic or the like, not shown, may be provided to removably close or cover the top of section 16, during operation, except for an area adjacent end plate 18** through which apples in finely divided form and pressing aid are to be supplied in any desired manner, such as for instance by conventional auger type conveyors. In the commercial construction, a shaft rotational speed of about 68 RPM has been found to produce satisfactory mixing results.

A suitable control circuit, not shown, is employed to control feed of apples and pressing aid to trough 12, operation of motor/gear box 30 and placement of the trough for discharge purposes in response to the filling of the press hoppers with charges to be pressed. Specifically, it is contemplated that each press hopper be provided with a suitable level or fill sensor intended to deengerize motors associated with apple and pressing aid feeds and motor/gear box 30 when its associated press hopper becomes filled with a charge; there being a suitable stepping or timing circuit for controlling pivotal movement of trough 12 for supplying the press hoppers in succession.

In accordance with a preferred mode of operation, section 16 is filled with a mixture of apples and rice hulls at all times during a working shift in which a press is in use, and the motors controlling feed of the apples and pressing aid and motor/gear box 30 are energized only during each press hopper filling operation. As by way of specific illustration, in a commercial installation designed to press charges equaling about 12 bushels of apples, including about 4% by weight of rice bulls the motors and motor/gear box are required to be driven for between 1 and $1\frac{1}{4}$ minutes to achieve mixing and discharge of a charge. Both prior to and at the completion of each successive mixing/discharge operation, section 16 remains essentially filled with material in the manner indicated in broken line at 60 in FIGS. 1 and 3; the viscous nature of such material tending to prevent loss or unintended discharge of material through opening 24, while motor/gear box 30 is deenergized. Any juice seeping from the material and escaping through opening 24 is simply collected in the press hopper then disposed beneath the discharge opening and does not adversely effect subsequent mixing/discharge or pressing operations. Inspection of cakes of pulp remaining at the completion of pressing operations reveals that essentially uniform mixing or dispersal of rice hulls within the charge is achieved by use of the present invention.

While a preferred embodiment of the present invention has been described for use in effecting uniform mixing of viscous material comprising finely divided apples and a pressing aid for use in forming a charge to be pressed in a juice extraction press, experiments with mixing of dry pressing aid indicate that a conveyor device employing paddles of the construction described above possesses more general utility. Accordingly, the present invention is only to be limited by the scope of the appended claims.

I claim:

1. A conveyor for mixing and transporting a viscous material, including finely divided fruit and a pressing aid, to provide a charge of material to a press, said conveyor comprising:

a horizontally disposed trough having an inlet end for receiving material to be mixed and an outlet end for discharging material after mixing thereof, and a driven mixing/transport conveyor device extending lengthwise within said trough for simultaneously mixing said material and transporting same for discharge at said outlet end, said trough including a mixing section of generally U-shaped cross-section, a first end plate joined to an end edge of said section and cooperating therewith to define said inlet end, a second end plate fixed in a spaced relationship to an opposite end edge of said section by a pair of side plates to define said outlet end, said opposite end edge, said second end plate and said side plates cooperating to bound a discharge opening permitting gravity discharge of material from said trough during operation of said conveyor device to mix and transport said material, said discharge opening having a width essentially coextensive with the widthwise dimension of said section and a length, as measured between said opposite end edge and said second end plate sufficient to permit unobstructed discharge of said material from said trough, said conveyor device including a drive shaft extending lengthwise within said trough and journaled for rotation adjacent its opposite ends by said first and second end plates and a plurality of paddles fixed to said shaft in spaced relationship at least throughout the length of said mixing section, each of said paddles including a transport flange portion and a pair of mixing flange portions, said transport flange portion extending generally radially of the axis of said shaft, having a surface thereof leading in the direction of shaft rotation arranged at an obtuse angle relative to said axis and a pair of opposite side edges arranged in a leading and trailing relationship relative to said outlet and inlet ends of said trough, respectively, said mixing flange portions being joined one to each of said opposite side edges and extending in opposite directions therefrom relatively towards said outlet and inlet ends, respectively, said mixing flange portions lying within planes disposed essentially parallel to said axis.

2. A conveyor according to claim 1, wherein each said paddle includes a mounting flange portion, said transport flange portion is joined to and upstands from said mounting flange portion and said paddle is fixed to said shaft by a threaded fastener passing through a radially extending through opening formed in said shaft.

3. A conveyor according to claim 1, wherein said opposite side edges converge in a direction outwardly of said shaft.

4. A conveyor according to claim 1, wherein each said paddle is formed by bending a rectangular metal plate to define a rectangular mounting flange portion, said transport flange portion and said pair of mixing flange portions, said mounting flange portion is fixed to said shaft, said transport flange portion is joined to said mounting flange portion and upstands therefrom, and said opposite side edges converge in a direction outwardly of said shaft.

5. A conveyor according to claim 4, wherein radially inner ends of said opposite side edges are disposed inwardly from adjacent opposite ends of said mounting flange portion, and radially inner ends of said mixing flange portions are joined to said mounting flange portion intermediate said opposite ends thereof and said radially inner ends of said opposite side edges.

6. A conveyor according to claim 5, wherein said mounting flange portion is adjustably fixed to said shaft for varying said obtuse angle by a threaded fastener fixed to depend from said mounting flange portion for receipt within a radially through opening formed in said shaft.

7. In a material mixing and transport device of the type having a driven shaft and a plurality of paddles fixed for rotation with the shaft and intended to mix material incident to transport thereof lengthwise of said shaft, the improvement wherein each of said paddles comprises:

a mounting flange portion for use in mounting said paddle on said shaft;

a transport flange portion joined to said mounting flange portion and arranged to upstand therefrom, said transport flange portion having opposite side edges extending in a direction away from said mounting flange portion and intended to be disposed relatively upstream and downstream relative to the direction of transport of said material lengthwise of said shaft and a transport surface extending between said opposite side edges and intended to face in the direction of rotation of said shaft and to form an obtuse angle relative to the rotational axis of said shaft; and a pair of mixing flange portions joined to said transport flange portion one along each of said opposite side edges and arranged to extend in opposite directions relative thereto, said mixing flange portions having mixing surfaces forming continuations of said transport surface and defining angles therewith determined to arrange said mixing surfaces within planes disposed essentially parallel to said rotational axis.

8. The improvement according to claim 7, wherein said opposite side edges converge in a direction away from said mounting flange portion and said transport surface approximates an isosceles trapezoid.

9. The improvement according to claim 8, wherein radially inner ends of said opposite side edges are spaced inwardly of opposite ends of said mounting flange portion and said mixing flange portions have relatively inner ends thereof joined to said mounting flange portion intermediate said inner ends of said opposite side edges and said opposite ends thereof.

10. The improvement according to claim 9, wherein said paddle is fabricated by bending a rectangular metal plate to define said mounting, transfer and mixing flange portions; and a fastener device for mounting said paddle on said shaft is fixed to depend from said mounting flange portion.

11. A paddle for use in a material mixing and transporting device including a drive shaft to which said paddle is mounted for rotation, said paddle comprising:

a metal plate bent to define a mounting flange portion for mounting said paddle on said shaft, a transport flange portion and a pair of mixing flange portions, said transport flange portion being joined along a bend line to said mounting flange portion centrally thereof and upstanding relative thereto, said mixing flange portions being joined to said transport flange portion one along each of a pair of bend lines extending from adjacent said bend line and in a direction away from said mounting flange portion, said mixing flange portions extend in opposite directions away from adjacent said transport flange portion, and said transport and mixing flange portions each having leading and trailing surfaces relative to the intending direction of rotation of said shaft, characterized in that said mixing flange portions are bent through angles relative to said transport flange portion to arrange said leading surfaces thereof to lie essentially parallel to the rotational axis of said shaft when said mounting flange portion is mounted on said shaft to position said leading surface of said transport flange portion to lie at a given obtuse angle relative to said rotational axis.

12. A paddle according to claim 11, wherein said metal plate and said mounting flange portion are of rectangular configuration, said pair of bend lines converge in a direction away from said mounting flange portion, and said leading and trailing surfaces of said transport flange portion approximate an isosceles trapezoid.

13. A paddle according to claim 11 or 12, wherein said mixing flange portions are additionally joined to said mounting flange portion intermediate said transport flange portion and opposite outer ends of said mounting flange portion.

14. A paddle according to claim 12, wherein said mixing flange portions are additionally joined to said mounting flange portion intermediate said transport flange portion and opposite outer ends of said mounting flange portion; and a threaded fastener is fixed to depend from said mounting flange portion for mounting same on said shaft.

* * * * *